US006116597A

United States Patent [19]

Rowe et al.

[11] Patent Number: 6,116,597

[45] Date of Patent: Sep. 12, 2000

[54] PERSONAL CONVENIENCE UNIT FOR ENHANCING PATRON USE OF GAMING MACHINES

[75] Inventors: Bruce C. Rowe, Germantown; Mark F. Bohlman, Memphis, both of Tenn.

[73] Assignee: Harrah's Operating Co., Inc., Memphis, Tenn.

[21] Appl. No.: 09/073,043

[22] Filed: May 5, 1998

[51] Int. Cl.[7] ..... A63F 1/18

[52] U.S. Cl. ..... 273/143 R; 463/40; 312/223.4; 312/280

[58] Field of Search ..... 312/107, 140.1, 312/140.3, 140.4, 223.4, 282, 280, 290, 196, 285; 52/27.5, 36.1, 40; 108/42, 44; 273/138.2, 143 R, 309; 463/20, 46

[56] References Cited

U.S. PATENT DOCUMENTS

| | | | |
|---|---|---|---|
| D. 169,041 | 3/1953 | Johnson . | |
| 540,206 | 5/1895 | Brooks | 312/285 X |
| 3,770,334 | 11/1973 | Weber | 312/223.4 |
| 3,837,720 | 9/1974 | Boris et al. . | |
| 3,862,785 | 1/1975 | Scheerhorn et al. | 312/223.4 |
| 4,440,457 | 4/1984 | Fogelman et al. . | |
| 4,657,257 | 4/1987 | Lubeck . | |
| 5,028,048 | 7/1991 | Watson et al. . | |
| 5,161,868 | 11/1992 | Hooser | 312/223.4 |
| 5,226,705 | 7/1993 | Rorke et al. | 312/196 |
| 5,285,991 | 2/1994 | Carlson . | |
| 5,411,192 | 5/1995 | Xiao | 108/42 X |
| 5,449,230 | 9/1995 | Murray . | |
| 5,549,375 | 8/1996 | Pagliaccio . | |
| 5,562,332 | 10/1996 | Stacy | 312/107 |
| 5,597,163 | 1/1997 | Takemoto et al. . | |
| 5,678,679 | 10/1997 | Berman . | |
| 5,687,651 | 11/1997 | Hurayt et al. | 312/282 X |
| 5,813,914 | 9/1998 | McKay et al. | 463/46 |
| 5,826,882 | 10/1998 | Ward | 312/223.1 X |
| 5,839,960 | 11/1998 | Parra et al. | 463/46 X |
| 6,003,013 | 12/1999 | Boushy et al. | 705/10 |

*Primary Examiner*—Anthony Knight
*Assistant Examiner*—Karlena D. Schwing
*Attorney, Agent, or Firm*—Fenwick & West LLP

[57] ABSTRACT

A personal convenience unit for use with a gaming machine provides various compartments and amenities that enhance the comfort and convenience of the gaming machine for a patron, thereby enabling and encouraging longer periods of play and greater customer loyalty. The personal convenience unit includes a base unit with at least one interior compartment that is separate from the interior portions of the gaming machine and which is lockable by the patron for securing personal items of the patron. The base unit may have a portion upon which the gaming machine rests, and a portion that extends on the side of the gaming machine. The personal convenience unit includes a personal amenity cabinet, preferably on the side of the gaming machine, which includes an open and recessed compartment to provide convenient access to and concealment of other personal items such as coin cups and the like. An upright backboard extending vertically from the base unit and supports additional amenities, such as a telephone mounting plate and telephone line jack for providing a telephone to the patron, a compartmentalized container for storing smaller personal items, a coin cup holder for holding a supply of empty coin cups and a pull out shelf for holding food, beverages, coin cups and the like. The base unit has a footrest for supporting the feet of a patron seated in front of the gaming machine.

10 Claims, 3 Drawing Sheets

FIG. 2B
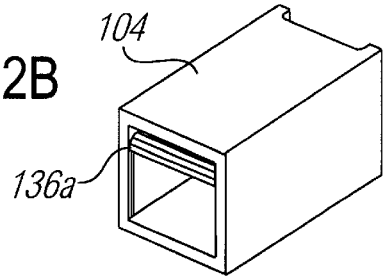
FIG. 2C
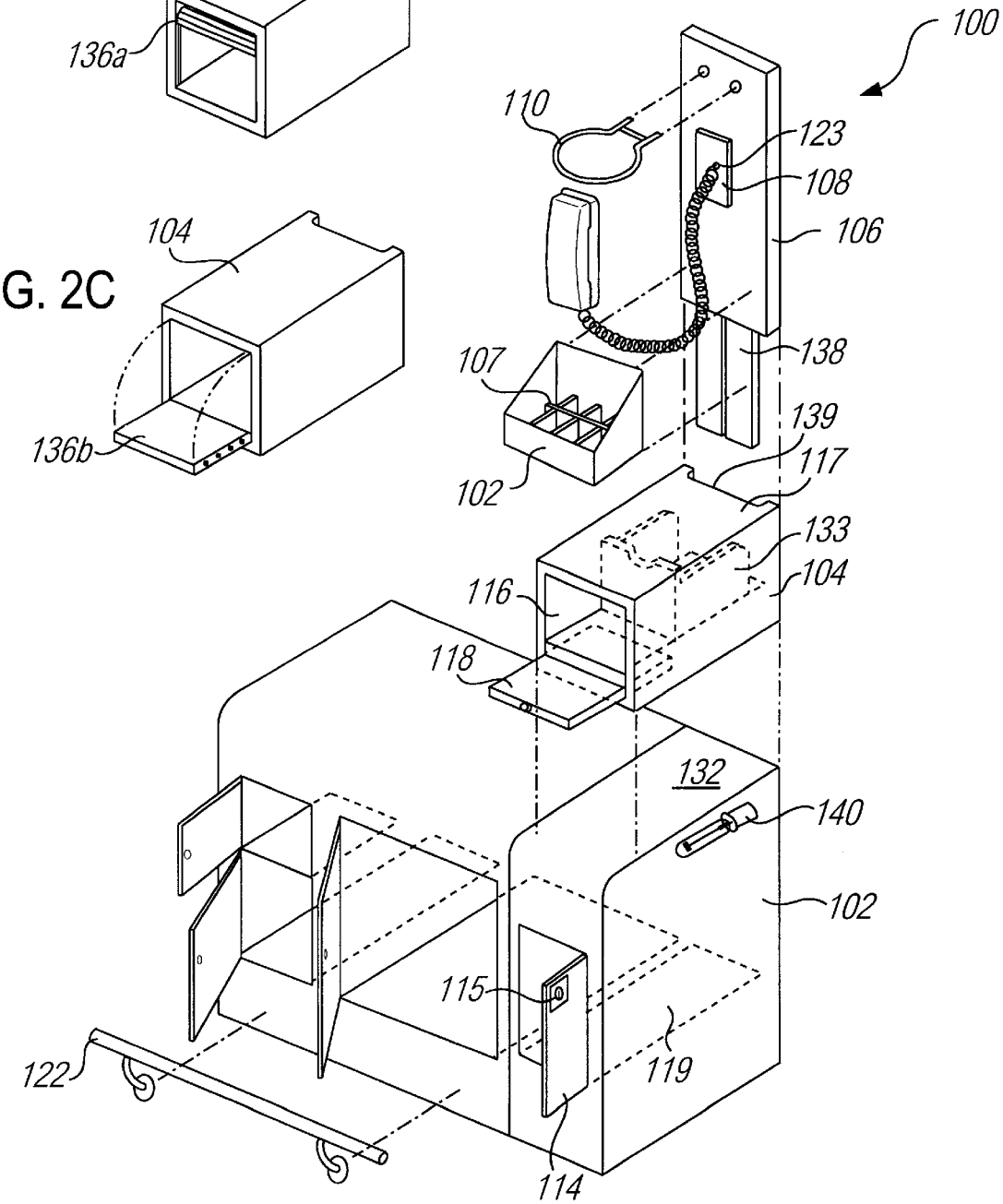
FIG. 2A

PERSONAL CONVENIENCE UNIT FOR ENHANCING PATRON USE OF GAMING MACHINES

BACKGROUND

1. Field of Invention

The present invention relates generally to gaming machines, and more particularly to apparatuses that enhance a patron's experience while using a gaming machine by providing various personal conveniences.

2. Background of the Invention

Casino profitability is directly a function of the amount of time patrons spend gambling in the casino at the various games and gaming machines. In particular, patrons of gaming machines, such as slot machines, video poker machines, and many of the new computerized multi-game gaming machines, and the like, are typically inclined to play such games for extended periods of time. In some cases a patron may stay at a single gaming machine for several hours, attempting to build up a large jackpot or other cumulative winnings.

Conventionally, the typical slot machine or gaming machine provides few, if any, apparatuses that make it easier for the patron to continue gaming at the machine for extended periods. For example, a patron may have a number of personal items, such as a purse, jacket, food, coins or the like which they want to keep with them. Currently, the patron must place such items near or about the gaming machine, and keep a watchful eye on these items to ensure their security. If the patron decides to momentarily leave the gaming machine they must take all of their personal items with them, since conventional gaming machines provide no means of securely storing such items. As another example, a patron may need to place a telephone call while in the casino, and thus have to leave the gaming machine, again taking all of their personal items, and find a telephone to use. This disruption in the patron's gaming is undesirable for the patron and the casino since it reduces the amount of time the patron is inclined to remain playing at the gaming machine. It also makes the patron's experience less enjoyable since the patron has to constantly monitor their personal items, and take them wherever he or she goes.

Accordingly, it is desirable to provide various apparatuses that enhance a patron's use of a gaming machine by providing for the storage and support of personal items, and that extend the ergonomic features accompanying gaming machines.

SUMMARY OF THE INVENTION

The present invention enhances the use of gaming machines by providing a personal convenience unit that increases the convenience and comfort of the gaming machine. By creating a more enjoyable gaming experience for the patron, the personal convenience unit also increases the loyalty of the patron to the casino and the likelihood that the patron will prefer to visit the casino offering the personal convenience unit over other casinos.

In one embodiment, the personal convenience unit of the present invention includes a base unit which has top, bottom, front, and back surfaces. The top surface is sufficiently sized to securely support a gaming machine, so that the gaming machine rests on the base unit. The front surface of the base unit has a lockable door to an interior compartment of the base unit. The interior compartment may be used by the patron to store various personal items, such as clothing, money, purses, food, and the like, as desired by the patron. The door is lockable by the patron to secure such personal items from others. Thus, the patron can lock their personal items in the interior compartment and if necessary leave the gaming machine for a period of time without having to worry about the safety of their personal items, and without having to take such items with them. The interior compartment is separate from any interior portions of the gaming machine, so that the patron does not have access to the interior portions of the gaming machine, and thereby cannot improperly operate, misuse, vandalize or steal from the gaming machine. The base unit further has a footrest extending from the front surface, to provide a stable support for the patron's feet while seated before the gaming machine for long periods of time. The base unit may additionally have other lockable doors in the front surface which open to interior portions of the gaming machine; these doors may be locked and opened only by casino personnel to provide maintenance to the gaming machine.

As another feature of the personal convenience unit, a backboard or upright portion extends vertically from the base portion along side of the gaming machine, and supports various other devices and appurtenances which further enhance the comfort and convenience of the personal convenience unit. In one embodiment, the backboard includes a telephone mounting plate including a telephone line jack that receives and mounts a telephone, and couples such telephone via the telephone line jack to a telephone system. This enables the patron to make telephone calls right from their place at the gaming machine, without having to leave the gaming machine to find a telephone. Another convenience provided by the backboard is a coin cup holder, such as a wire loop, for holding empty coin cups. This gives the patron easy access to the coin cups as they are needed to hold the patron's winnings. Another convenience provided by the backboard is a compartmentalized container, open at the top, that contains a number of individual compartments formed by vertical dividing walls. In this container the patron may store for easy access various personal items, such as pens and pencils for marking game tickets, tissues, cigarettes, gloves, matches and lighters, and the like.

Another feature that may be added to the base unit is a personal amenity cabinet which rests on top of the base unit next to the side of the gaming machine. The personal amenity cabinet has top, bottom, back and side surfaces that form a recessed compartment accessible from the front of the cabinet. This recessed compartment allows the patron to store personal items in a more concealed manner, out of the view of other patrons near the gaming machine. For example, the recessed compartment of the personal amenity cabinet may be used to conceal a cup of coins, a purse or wallet, coin racks for high denomination coins or tokens, or other valuable items. The front of the personal amenity cabinet may have no door at all to allow easy and immediate access, or it may have various types of doors, such as a fold-down door, or a roll-top door that rolls up and into the recessed compartment. The personal amenity cabinet preferably has a pull out tray that can be pulled out from the bottom surface of the personal amenity cabinet and extend outwardly from the front of the cabinet. This pull out tray is useful for retaining personal items such as drinks, cigarettes, and the like, of the patron.

In another embodiment, the personal convenience unit rests alongside a gaming machine, but does not provide a supporting surface for it. In this embodiment, the base unit has top, bottom, front, back, and side surfaces, and again the front surface has a door lockable by the patron, which accesses an interior compartment in which the patron may securely store personal items. The interior compartment is separate from the interior portions of the gaming machine. This embodiment includes an upright portion or backboard which includes the telephone mounting plate and telephone line jack as described above. This embodiment may also include the coin cup holder, compartmentalized container, and personal amenity cabinet as described above.

BRIEF DESCRIPTION OF THE DRAWINGS

FIG. 2*a* is an exploded view of the first embodiment of the personal convenience unit.

FIG. 2*b* is an alternate embodiment of the personal amenity cabinet.

FIG. 2*c* is another alternate embodiment of the personal amenity cabinet.

DETAILED DESCRIPTION OF THE PREFERRED EMBODIMENT

Figure 1:
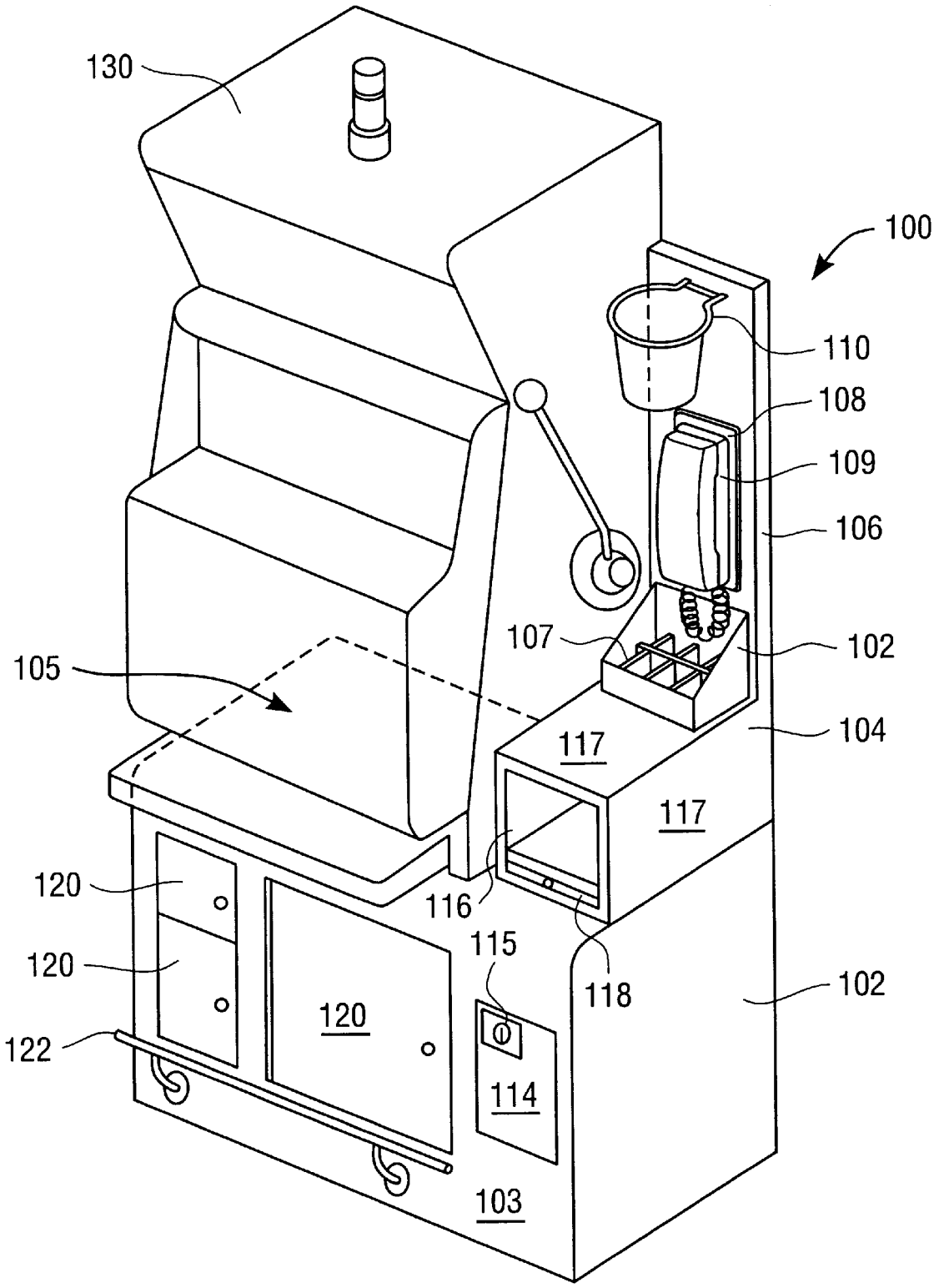
FIG. 1 is a perspective illustration of a first embodiment of the personal convenience unit.

Referring now to FIGS. 1 and 2*a*, there is shown respectively a perspective view of a first embodiment of the personal convenience unit 100 of the present invention, and an exploded view of the first embodiment. In the first embodiment, the personal convenience unit 100 includes a base unit 102 having top, bottom, front, and side surfaces 103. The width of the base unit 102 is greater than the width of a gaming machine 130 to be used with the personal convenience unit 100, and so the top surface 103 has a portion 105 upon which the gaming machine 130 rests. Gaming machines 130 include slot machines, video or computerized gambling machines such as poker, keno, and the like, and any other gaming or gambling device designed to be played from a sitting or standing positing in front of the gaming machine.

The front surface 103 of the base unit 102 has a door 114 with a lock 115, which opens to an interior compartment 119. The lock preferably is surrounded by a recessed finger pull to allow the user to open the door, or a separate handle may be employed. The interior compartment 119 is separate from the interior portions of the gaming machine 130, such that the patron does not have access to the interior portions of the gaming machine 130 from within the interior compartment 119. The patron is given a key to the lock 115 by a casino personnel, and may securely lock various personal items within the interior compartment 119, thereby eliminating the need to monitor such items or take them when temporarily stepping away from the gaming machine 130. The interior compartment 119 may also include a light 140 that is controlled by a switch that engages when the door 114 is opened. Additional interior compartments having different sizes which are lockable and accessible by the patron may also be provided.

The figures illustrate the base unit 102 with a generally rectangular footprint for convenience of illustration. However, other footprints and base sizes may be used according to the location of the gaming machine 130 and personal convenience unit 100 in the casino. For example, the base unit 102 may be trapezoidal, with the back surface being narrower than the front surface, for use in a circular or curved arrangement of a number of gaming machines 130 and personal convenience units 100.

In a preferred implementation of the first embodiment, the front surface 103 of the base unit 102 includes other lockable doors 120, which open to interior compartments or interior portions of the gaming machine 130. The doors 120 may be opened only by casino personnel, and not a patron, to allow for maintenance of the gaming machine 130, such as insertion or removal of coinage, adjustment of mechanical or electrical components of the gaming machine 130, and the like.

A footrest 122 is attached to a bottom portion of the front surface 103 of the base unit 102. The footrest 122 may be a fixed or folding rail, that is sized and vertically positioned to provide support to the feet of a patron seated in front of the gaming machine 130. This ergonomic feature makes it easier for the patron to sit and play at the gaming machine 130 for extended periods of time by relieving unnecessary pressure on the feet and legs.

The first embodiment includes a personal amenity cabinet 104 which rests on a portion 132 of the top surface 103 that extends beyond the width of the gaming machine 130. The personal amenity cabinet 104 has top, bottom, back, and side surfaces 117. The top surface of the base unit 102 may serve as the bottom surface 117 of the personal amenity cabinet 104. These surfaces 117 form a recessed compartment 116 that is accessible from where a patron sits in front of the gaming machine 130 and personal convenience unit 100. The recessed compartment 116 is used by the patron to store personal items concealed from the view of other patrons who may be nearby. For example, the patron may place coin cups with coins, a purse, wallet or other valuable items within the recessed compartment 116, so that they are within immediate arm's reach, but out of sight of others. Preferably, the personal amenity cabinet 104 has a pull out tray 118 that may be forwardly extended from the bottom surface 117 (as seen in the exploded view of FIG. 2*a*), and provide an additional surface area upon which the patron may place drinks, cigarettes, and the like for immediate and convenient access while at the gaming machine 130. The personal amenity cabinet 104 may have various different front configurations that include different types of doors 136*a* (FIG. 2*b*), 136*b* (FIG. 2*c*) for closing off the recessed compartment 116. These doors include a fold down door 136*b*, hinged along a front, bottom edge of the personal amenity cabinet 104 below the recessed compartment 116, or a roll-down type door 136*a*, which rolls up and back into the recessed compartment 116 on tracks. Either of these implementations allow the patron to further conceal personal items within the recessed compartment 116 while affording quick and convenient access thereto.

Also as seen in FIG. 2*a*, the personal amenity cabinet 104 may include inside the recessed compartment 116 a slideable and removable tray 133 that may be used to store additional personal items, or to limit the depth of the recessed compartment 116 and make it an exact fit for a coin cup or coin trays. The removable tray 133 may also be used to conceal internal wiring. The tray 133 may be slid sufficiently forward (or removed entirely) to allow access to its rear containing portion.

A backboard 106 forms an upright portion extending vertically from the back of the personal amenity cabinet 104 (or the base unit 102) and along the side of the gaming machine 130. The backboard 106 supports further convenience items as follows. A telephone mounting plate 108 includes a standard RJ-11 telephone line jack 123, and receives a telephone 109 to be mounted on the backboard 106, and coupled to a telephone line. In this fashion the patron can conveniently make telephone calls directly from the gaming machine 130, without having to leave the gaming machine 130.

The backboard 106 further includes a cup holder 110 for holding a supply of empty coin cups. The cup holder 110 may be a wire ring formed in shape and diameter of a coin cup, a formed plastic holder, or other similar construction. This feature provides the patron with a convenient source of coin cups to hold gambling winnings.

In one implementation of the first embodiment, the rear portion of the personal amenity cabinet 104 forms an indented mortise 139 that corresponds to a tenon 138 portion at the lower end of the backboard 106. The tenon 138 fits securely into the mortise 136 to couple the backboard 106 to the personal amenity cabinet 104.

Resting on a top surface of the personal amenity cabinet 104 and against the backboard 106 there is provided a compartmentalized container 102. The container 102 has front, back, and side surfaces, either integrally constructed as an open top box, or with the face of the backboard 106 serving as the back surface. The container 102 is open on the top, and between the various surface are vertical dividing walls 107 which divide the container into a number of smaller compartments. The compartmentalized container 102 provides the patron with convenient and accessible storage for small personal items, such as pens and pencils for filling in gaming tickets, tissues, matches, mints, hand wipes, casino promotional literature, and the like.

Figure 3:
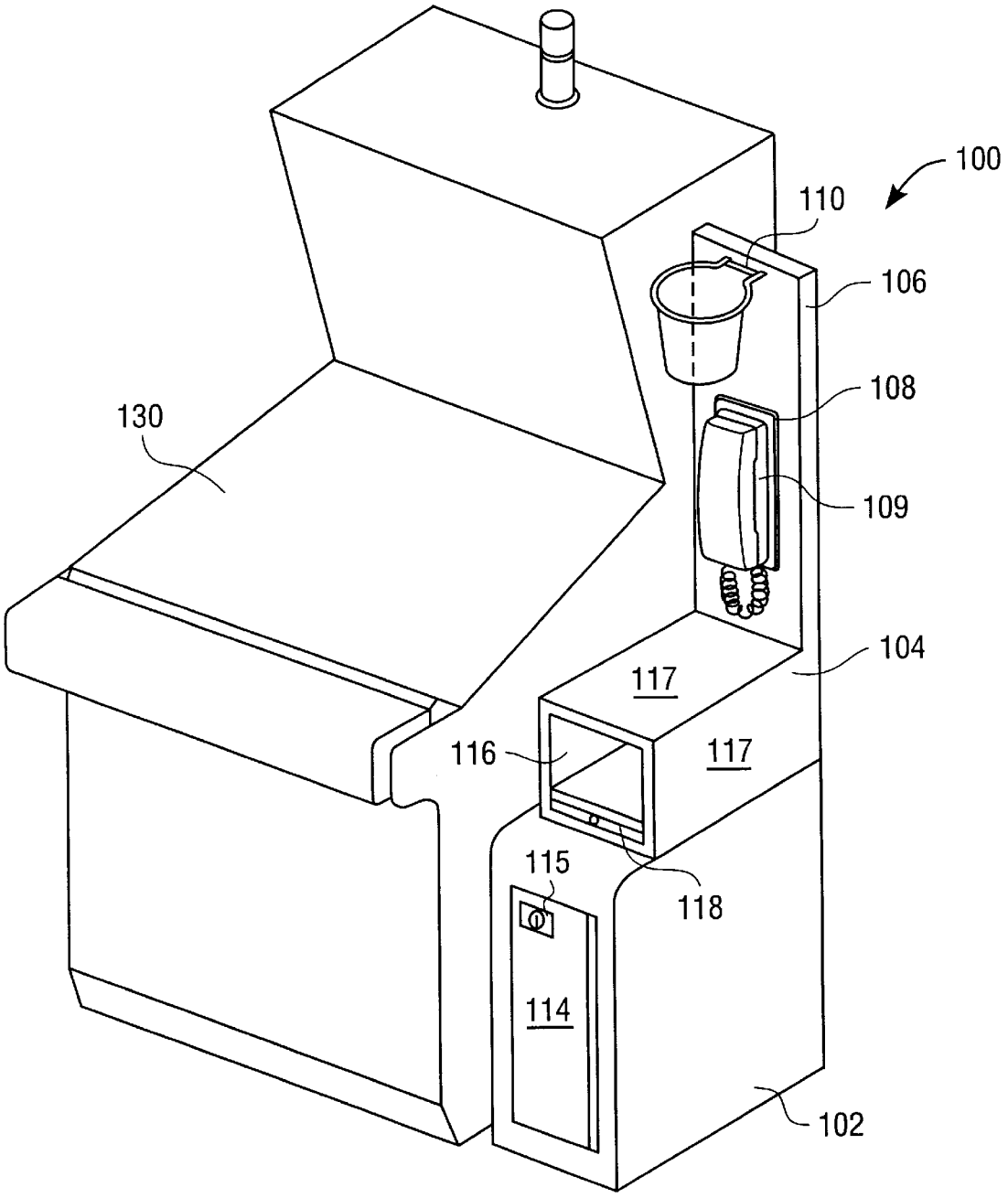
FIG. 3 is an illustration of a second embodiment of the personal convenience unit.

Referring now to FIG. 3 there is shown an illustration of a second embodiment of the personal convenience unit 100. In this embodiment, the personal convenience unit 100 is designed for placement beside a gaming machine 130, and does not include a top portion of the base unit 102 upon which to support the gaming machine 130. This embodiment is used with slant type gaming machines known to those of skill in the art. In this embodiment, the base unit 102 includes the interior compartment 119 with front door 114 and lock 115, as described above. The personal amenity cabinet 104 may again be disposed on a top surface of the base unit 102, providing the recessed compartment 116, pull out tray 118, and optional doors 136 and tray 133 as described. Also, the second embodiment preferably includes the compartmentalized container 102 and telephone mounting plate 108 with telephone line jack 123.

The above described figures illustrate various embodiments of the present invention. Those of skill in the art will appreciate that the present invention may be embodied in numerous other constructions with various combinations or substitutions of the above described features. For example, more or fewer interior compartments, storage bins and shelves may be provided. Other amenities such as radios, televisions and other electronic devices may also be installed. Other cabinet shapes, or different numbers of individual cabinets, or different relative sizes of the various cabinets may be used. Accordingly, the present invention should only be limited by the attached claims.

In summary, the present invention provides various apparatuses for enhancing the convenience and comfort of a gaming machine. The present invention provides convenient and secure storage of personal items in a personal convenience unit that adjoins a gaming machine and has lockable interior compartments. The present invention further provides amenities on the personal convenience unit that enable the patron to stay longer at the gaming machine, such as a telephone, coin cup holder, various open compartments for immediate access to personal items, and recessed compartments for concealing other personal items, and a footrest.

What is claimed is:

1. A storage cabinet adapted for use in combination with a casino gaming machine, the combination comprising:

a base unit having top, bottom, front, back, and side surfaces, the base unit having a first compartment, the front surface having a first door for accessing the first interior compartment, the first door having a first lock, one of the side surfaces adapted for being adjacent a side surface of the casino gaming machine;

a casino gaming machine resting on the top surface of the base unit;

an upright member extending vertically from a rear portion of the base unit and having a telephone mounting plate with a telephone line jack for receiving and coupling a telephone to the telephone line jack, and having a coin cup holder.

2. The storage cabinet of claim 1, further comprising:

a personal amenity cabinet coupled to the base unit, and having at least one recessed compartment accessible from the front of the storage cabinet, a bottom surface of the personal amenity cabinet having a pull out tray for extending outwardly from a front of the personal amenity cabinet and for retaining items of a patron.

3. The storage cabinet of claim 1, further comprising:

a container coupled to the upright member and having a front, back, side and bottom surfaces forming a compartment, and having at least one vertical dividing wall parallel, and dividing the compartment into at least two sub-compartments.

4. An apparatus for casino gaming, comprising:

a casino gaming machine;

a base unit having top, bottom, front, back, and side surfaces, the base unit having a first compartment, the front surface having a first door for accessing the first interior compartment, the top surface of the base unit is wider than the casino gaming machine one of the side surfaces being adjacent a side surface of the casino gaming machine; and having a coin cup holder.

5. The apparatus of claim 4, wherein the top surface provides a first top portion that supports the casino gaming machine, and a second top portion that extends beyond the width of the casino gaming machine, and wherein the upright member is coupled to and extends from the second top portion.

6. The apparatus of claim 4, further comprising an upright member extending vertically from a rear portion of the base unit and along side the casino gaming machine, and having a telephone mounting plate with a telephone line jack for receiving and coupling a telephone to the telephone line jack.

7. An improved casino gaming machine system including a casino gaming machine, the casino gaming machine having a slot for receiving a wager and one or more interfaces enabling use of the machine by a patron, the improvement comprising:

a base unit having having front, back, top, bottom, left and right surfaces, the top surface forming a stable surface adapted to support the casino gaming machine, the top surface being wider than the gaming machine and having one or more interior compartments, the front surface having one or more doors for accessing the interior compartments; and a cup holder coupled to the front surface.

8. The casino gaming machine system of claim 7, further comprising:

an upright member extending vertically from a rear portion of the base unit and having a telephone mounting plate with a telephone line jack for receiving and coupling a telephone to the telephone line jack, and having a coin cup holder.

9. The casino gaming machine system of claim 7, further comprising:

a personal amenity cabinet coupled to the base unit, and having at least one recessed compartment accessible from the front of the storage cabinet, a bottom surface of the personal amenity cabinet having a pull out tray for extending outwardly from a front of the personal amenity cabinet and for retaining items of a patron.

10. The casino gaming machine system of claim 9, further comprising:

a container coupled to the upright member and having a front, back, side and bottom surfaces forming a compartment, and having at least one vertical dividing wall parallel, and dividing the compartment into at least two sub-compartments.

* * * * *